United States Patent [19]

Lin

[11] Patent Number: 4,706,071

[45] Date of Patent: Nov. 10, 1987

[54] WARNING APPARATUS AGAINST THE COVERLET OUT OF POSITION

[76] Inventor: Min-Shin Lin, 116 Yuan tzyy Street, Taichung, Taiwan

[21] Appl. No.: 852,800

[22] Filed: Apr. 16, 1986

[51] Int. Cl.[4] ..... G08B 21/00

[52] U.S. Cl. ..... 340/568; 340/540; 340/573

[58] Field of Search ..... 340/568, 573, 540

[56] References Cited

U.S. PATENT DOCUMENTS 2,908,899 10/1959 Crafts ..... 340/568
4,205,671 6/1980 Lassen ..... 340/573
4,411,034 10/1983 Williams ..... 340/568
4,614,939 9/1986 Wang ..... 340/568

*Primary Examiner*—Glen R. Swann, III
*Attorney, Agent, or Firm*—Browdy and Neimark

[57] ABSTRACT

A warning apparatus to signal that a coverlet is out of position, includes a belt, a buckle mounted on one end of the belt, a rim on the buckle, a catch mounted on the other end of the belt, and a photoelectric circuit of a first photo sensitive element provided on the buckle and a second photo sensitive element provided on the belt. The first and second photo sensitive elements are separated a predetermined distance and connected in parallel to the photoelectric circuit means, and a buzzer is connected to the photoelectric circuit means.

1 Claim, 3 Drawing Figures

WARNING APPARATUS AGAINST THE COVERLET OUT OF POSITION

BACKGROUND OF THIS INVENTION

This invention relates to a warning apparatus against the coverlet out of position, particularly to a warning apparatus for the condition when the children kick off the coverlet.

For the children in sleep during the night usually kick off the coverlet and the parents is not possible to discover the condition in time, the children get cold. This condition gets worse especially in the winter.

To improve this condition, one object of this invention is to provide a warning apparatus which may send signals when the children kick off the coverlet whereby the parents may discover in time to place back the coverlet on the children.

The object, merits and a fuller understanding of the present invention will be obtained by those having ordinary skill in the art when the following detailed description of the best mode contemplated for practicing the invention is read in conjunction with accompanying drawings wherein like numerals refer to like or similar parts and in which:

DETAILED DESCRIPTION OF THIS INVENTION

This invention relates to a warning apparatus for when a coverlet is out of position, particularly to a warning apparatus for such a condition when the children kick off the coverlet.

Figure 1:
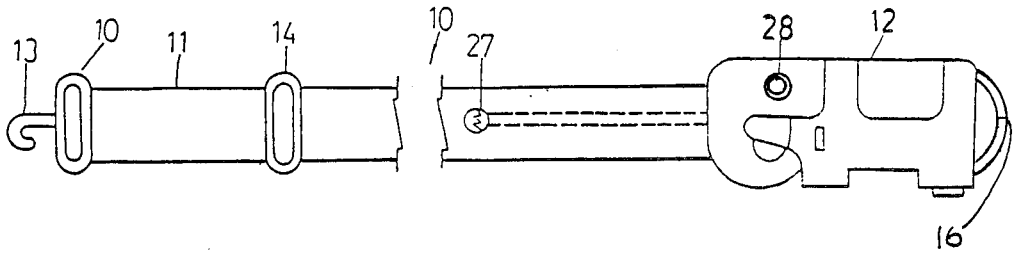
FIG. 1 is a plan view of a preferred embodiment of this invention.

As shown in FIG. 1, the warning apparatus 10 includes a belt 11 on one end of which a buckle 12 having a rim 16 is mounted, on the other end of which a catch 13 is mounted, and on the body of which an adjustment slide 14 is mounted. The buckle 12 can be provided in an elephant shape, to have a circuit means 15 (not shown in FIG. 1) therein.

Figure 2:
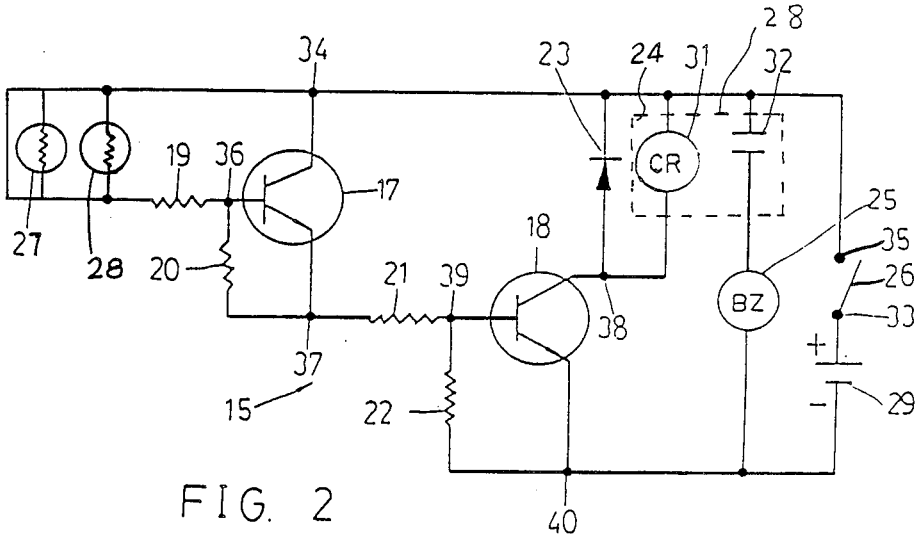
FIG. 2 is a circuit diagram of a preferred embodiment of this invention.

Further as shown in FIG. 2, the circuit means 15 comprises a first transistor 17, a second transistor 18, a first bias resistor 19, a second bias resistor 20, a third bias resistor 21, a fourth bias resistor 22, a diode 23, a relay 24, a buzzer 25, a switch 26, two photo sensitive resistor (CDS) 27 & 28 and a battery 29. The relay 24 comprises an electromagnetic coil 31 and a contact 32 normally opened. The switch 26 is connected with one end 33 to the positive end of the battery 29 and the other end 35 to the collector 34 of the first transistor 17. Between the base 36 and emitter 37 of the first transistor 17 is connected in series the second bias resistor 20. The collector 38 of the second transistor 18 is connected in series to the parallel combination of the diode 23 and the electromagnetic coil 31, both of which are connected in parallel to the end 35 of the switch 26. Between the base 39 of the second transistor 18 and the emitter 37 of the first transistor 17 is connected in series the third bias resistor 21. The emitter 40 of the second transistor 18 is connected to the negative end of the battery 29, and between the emittor 40 and base 39 is connected in series the fourth bias resistor 22. The buzzer 25 is connected with one end to the negative pole of the battery 29 and the other end to one side of the contact 32 of the relay 24. The other side of the contact 32 is connected to the end 35 of the switch 26. The parallel photo sensitive resistors 27 & 28 are connected in series with one end to the end 35 of the switch 26 and the other end to one end of the first bias resistor 19, the other end of which is connected to the base 36 of the first transistor 17. In assembly, the first photo sensitive resistor 27 is fixed on the central portion of the belt 11 and the second photo sensitive resistor 28 is provided on the eyes of the elephant shaped buckle 12.

In use, the warning apparatus for when the coverlet is out of position is covered by the coverlet and not exposed to the light, as a result of which a resistance value of the first transistor 17 is great and therefore the first transistor 17 remains idle. However, when the children kick off the coverlet to cause either of the photo sensitive resistors 27 & 28 to be exposed to the dim light, the resistance value turns low. Thus, there is a small bias voltage on the base 36 of the first transistor 17 effected by the first bias resistor 19. The electric current flows from the collector 34 to the emittor 37 of the first transistor 17, and further to the base 39 of the second transistor 18, to effect a bias voltage on the third bias resistor 21. When the second transistor 18 is in a saturated state, an electric current flows through the electromagnetic coil 31 of the relay 24, to cause the normally opened contact 32 to be closed. At this instant, the buzzer 25 will make sound to wake up the adult to place back the coverlet on the children. Then the photo sensitive resistors 27 & 28 return to high resistance value, as a result of which the contact 32 of the relay 24 becomes normally opened again and the buzzer 25 stops operating.

Figure 3:
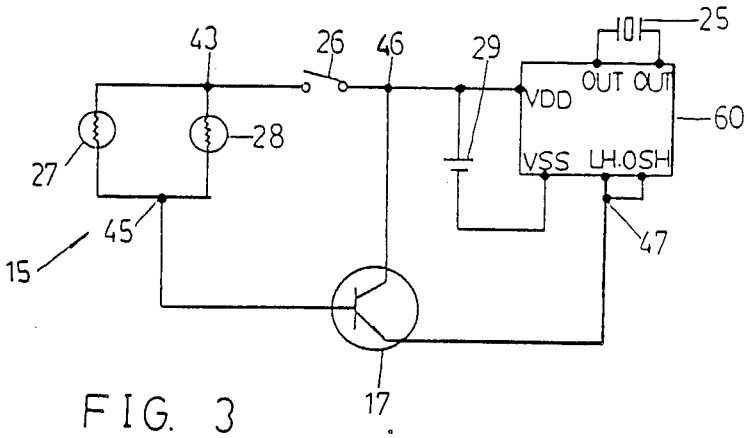
FIG. 3 is a circuit diagram of another preferred embodiment of this invention.

As shown in FIG. 3, the electric circuit means 15 may alternatively employ an integrated circuit 60 which comprises two photo sensitive resistors 27 & 28, a switch 26, a battery 29, a buzzer 25 and a first transistor 17. The photo sensitive resistors 27 & 28 which are connected in parallel are connected with one end 43 to the positive end (VDD) of the integrated circuit 60 through the switch 26, and connected with their other end to the base 45 of the first transistor 17. The collector 46 of the first transistor 17 is connected to the positive end (VDD) of the integrated circuit 60, and the emittor 47 is connected to the trigger point (OSH, LH) of the integrated circuit 60. The positive and negative ends of the battery 29 are respectively connected to the positive and negative ends (VDD & VSS) of the integrated circuit 60. The buzzer 25 is connected to the out point (OUT) of the integral circuit 60. All the elements disclosed above may be assembled on a PC board and provided within the elephant-shaped buckle 12.

It is to be noted that the above description aims to explain, however not to limit, the concept of this invention.

I claim:

1. A warning apparatus to signal that a coverlet of a bed is out of position, comprising:

a belt;

a buckle mounted on one end of said belt;

a rim on said buckle;

a catch mounted on the other end of said belt;

a photo electric circuit means comprising a first photo sensitive element provided on said buckle, and a second photo sensitive element provided on said belt, said first and second photo sensitive elements being separated a predetermined distance and connected in parallel in said photo electric circuit means; and a buzzer connected to said photo electric circuit means;

wherein when said belt is buckled about a child in said bed and covered with said coverlet, and when said coverlet is kicked out of position by said child, said buzzer provides said warning as a result of at least one of said photo sensitive elements receiving more light when said coverlet is out of position compared to when it is in position over said child buckled with said belt.

* * * * *